US006857246B2

(12) United States Patent
Erbetta et al.

(10) Patent No.: US 6,857,246 B2
(45) Date of Patent: Feb. 22, 2005

(54) TUBULAR STRUCTURE ARRANGEMENT

(76) Inventors: Robert Anthony Erbetta, P.O. Box 44, Marblehead, MA (US) 01945; Henry C. Waters, 85 Newcastle St. #509, Lynn, MA (US) 01905

( * ) Notice: Subject to any disclaimer, the term of this patent is extended or adjusted under 35 U.S.C. 154(b) by 85 days.

(21) Appl. No.: 10/171,813

(22) Filed: Jun. 14, 2002

(65) Prior Publication Data

US 2003/0005953 A1 Jan. 9, 2003

Related U.S. Application Data

(63) Continuation-in-part of application No. 09/301,403, filed on Apr. 28, 1999, now abandoned.

(51) Int. Cl.[7] ..... E04H 15/34; F16B 7/00

(52) U.S. Cl. ..... 52/653.2; 52/655.1; 135/124; 135/147; 135/159; 135/909; 403/169; 403/217

(58) Field of Search ..... 135/906, 909, 135/99, 157, 158, 159, 147, 121, 125; 52/653.2, 655.1; 403/169, 171, 175, 182, 217

(56) References Cited

U.S. PATENT DOCUMENTS 143,669 A * 10/1873 Combs ..... 403/73
2,757,677 A * 8/1956 Denn ..... 135/160
3,074,203 A * 1/1963 Paksy ..... 446/120
3,424,178 A * 1/1969 Yazaki ..... 135/157
4,683,901 A * 8/1987 Mitchell ..... 135/97
5,167,246 A * 12/1992 Mortenson ..... 135/153
5,226,440 A * 7/1993 Fuhrman ..... 135/159
5,584,311 A * 12/1996 Schaefer ..... 135/128
5,595,203 A * 1/1997 Espinosa ..... 135/124
5,598,668 A * 2/1997 Isom ..... 52/86
5,660,002 A * 8/1997 Lashinger ..... 52/63
5,927,363 A * 7/1999 Olsen ..... 160/83.1
D477,527 S * 7/2003 Bradford
6,616,212 B1 * 9/2003 Bishop ..... 296/100.18
2002/0170588 A1 * 11/2002 Seo ..... 135/90

* cited by examiner

*Primary Examiner*—Robert Canfield
(74) *Attorney, Agent, or Firm*—Don Halgren

(57) ABSTRACT

A customizable enclosable frame assembly for providing a housing structure comprising an arrangement of elongated members connected by a plurality of connectors to define the frame assembly. The connectors include a plurality of knuckle joint assemblies for articulably connecting the elongated members. The connectors also include a plurality of slip-T members for connecting the elongated members to define a customizable, adjustable base of the customizable frame assembly.

10 Claims, 8 Drawing Sheets

TUBULAR STRUCTURE ARRANGEMENT

This is a continuation-in-part application of our U.S. patent application Ser. No. 09/301,403, filed Apr. 28, 1999, now abandoned, and incorporated herein by reference in its entirety.

BACKGROUND OF THE INVENTION

1. Field of the Invention

This invention relates to tubular frame structures and more particularly to a multi-component assembly for the manufacture of a customized structure.

2. Prior Art

Small framed structures, particularly intended for a temporary basis, are often flimsy and difficult to assemble, disassemble or re-use.

It is an object of the present invention to provide a frame assembly which is easily put together and disassembled and which is readily reusable in a further construction.

It is a further object of the present invention to provide a frame assembly arrangement which is light weight, compact, long-lasting, resistant to weather and corrosion, and which is readily coverable by a variety of fabric or planar material.

BRIEF SUMMARY OF THE INVENTION

The present invention comprises a versatile, easy to assemble, readily customizable frame assembly to be utilized as a temporary or a permanent structure which may be covered by an external panel or fabric. Such a frame assembly, for example, may comprise a plurality of elongated horizontally disposed tubes connected in a rectilinear manner by, for example, a three way corner member, which each comer member mating with a vertical tube which is connected to a knuckle joint at its uppermost end. The knuckle joints are connected by horizontally disposed tubular members which may be bent in a curved fashion at the comers, and which tubular members are themselves abutively held connected together by a straight coupling member. The knuckle joints may be further connected to a corner brace, directed towards a central hub, connected thereto by a further set of knuckle joints. A bent or formed ring may be passed through each knuckle joint to form the hub, each of which knuckle joint is connected to a 5-way hub member. A center pole may be arranged to extend through the frame assembly from it's horizontal base, having a flange therearound and through a central bore within the 5-way hub for central support of the entire frame assembly, depending upon size and elevation.

The 5-way hub comprises a molded, central X-shaped housing, having a lower boss. The X-shaped housing has four connector housings equally spaced therearound at a 90 degree angle with respect to the longitudinal axis of the center bore. Each connector housing has a receiving bore formed therein. Each receiving bore has a closed innermost end and an open radially-outermost end. The central bore of the center cylinder has an open upper end which extends through the boss into an open lower end. Each connector housing of the 5-way hub is abutively attached to a knuckle joint by an internal tubular coupling sleeve in the respective receiving bores. The internal connector or coupling sleeve connects the receiving bore of each respective connector housing on the 5-way hub with a corresponding receiving bore on a connector housing of an adjacent knuckle joint. Each connector housing of the 5-way hub is connected to a respective knuckle joint by an internal sleeve matingly arranged therebetween, in their respective receiving bores.

A first knuckle joint and a second knuckle joint are articulably arranged adjacent one another to define a support for an internal tube arranged therebetween. The tube may be ribbed, and it may be formed in a curved manner as by heat from a heating lamp, a heating element, or a heated blanket or the like. A knuckle joint assembly is thus comprised of a first knuckle joint and a second knuckle joint. Each knuckle joint has a connector housing having a receiving bore extending therein. The receiving bore, as aforementioned has an inner closed end, and an open second or outer end. The receiving bore has a longitudinal axis which is coaxial with the longitudinal axis of the connector housing. The connector housing has an adaptor ring unitarily formed at the closed end of the connector housing. The adaptor ring has an annular surface which mates against a corresponding annular surface of a corresponding adaptor ring of a second knuckle joint of the joint assembly. The second knuckle joint is unitarily formed with a connector housing. The second knuckle joint connector housing has a receiving bore in a manner similar to that of the first knuckle joint. A cylindrically-shaped sleeve may be inserted through the respective bores of the respective first and second adaptor rings to connect the two knuckle joints together. The sleeve may be comprised of an elongated tube or the sleeve may be comprised of a shortened tube which is adapted to permit a smaller diameter tube to be inserted therewithin.

The elongated tube between adjacent knuckle joint assemblies on the frame assembly may have a supported tube carried thereon. The supported tube would be parallel to and adjacent the carrier tube which is arranged between adjacent knuckle joint assemblies. The carrier tube would have one or more "slip T" saddle connectors therewith.

The "slip T" saddle connector comprises an adaptor ring, unitarily formed with a connector housing saddle. The adaptor ring comprises a cylindrically shaped member connected to a generally cylindrically shaped saddle housing. The saddle housing comprises a saddle joint with a generally circumferentially shaped opening arranged transversely with respect to the longitudinal axis of the saddle housing. The longitudinal axis of the saddle is parallel to the longitudinal axis of the adaptor ring in a first embodiment thereof. The saddle comprises a formed opening of generally cylindrical configuration, which opening is an arcuate shape of between 180 degrees to about 240 degrees.

The slip T connector saddle joint in a further embodiment may have a connector housing arranged unitarily with the adaptor ring so that the saddle joint has a longitudinal axis which is transverse with respect to the longitudinal axis of the bore of the adaptor ring. In such a slip T saddle connector with a cross-aligned axis arrangement, a carrier tube may be arranged through the bore of the adaptor ring with the saddle connector housing biasedly engaging and 'slidably supporting a support tube, the axes of each tube being transverse with respect to one another. The saddle connector housing has its angularity of the opening such that the supported tube is snapped into the opening or maybe slid therethrough by virtue of the greater than 180 degree periphery of the saddle joint contact point arrangement.

The frame assembly as aforementioned, may include a straight T component, having an elongated adaptor ring with a bore extending therethrough, and a connector housing of generally cylindrically configuration, unitarily formed therewith, having a receiving bore therein. The receiving bore in this embodiment, has a closed innermost end.

A further component of the frame assembly described hereinabove, includes a unitary three way comer member having three connector housings, each of generally cylindrical shape, meeting at a common boundary, to define a connecting joint for the receipt of elongated tubes at the corner of a structure. Each three way comer member has its connector housings with their respective receiving bores having a closed inner end.

A further frame assembly utilizing some of the components in the aforementioned examples may comprise a rectilinear configuration of elongated tubular members defining a base. The rectilinear formation of the base comprises a pair of parallel side members and a pair of parallel end members. The parallel side members may each have a plurality of straight T components slidably disposed thereon. The connector housing of each straight T member may have an arcuately curved pole extending therefrom. Each opposed arcuately curved pole from the respective side portions of the rectilinear base may be connected by a curved tube, which curved tube is connected to its respective arcuate curved poles by an insert connector arranged therebetween. The frame assembly of this/these example/s thus may be covered by a flexible fabric, or frame panel arrangement so as to permit the safe enclosure of for example a bicycle, a motorcycle, a play house, or a tool arrangement therewithin.

The elongated tubing connecting the particular corners or knuckle joint assemblies of the present invention may be comprised of one and one quarter inch diameter PVC tubing or fluted tubing. Pins may be arranged between the respective connector housings and the elongated tubings received therein, to act as anchors for securement thereof. The heating of the elongated tubing may be accomplished by the aforementioned blanket or heated element so as to raise the temperature of the tubing to about 400 degrees Fahrenheit to permit that elongated tubing to be bent into a corner or into an arcuate shape as necessary. The tubular members may in one embodiment, be solid, they may have electrical conductors, lights or fluid ducting components connectively arranged therewithin.

Thus what has been shown is a unique framing assembly for the temporary or permanent construction of an enclosure which is readily customizable for a variety of connector components.

The invention thus comprises a customizable enclosable frame assembly for providing a housing structure comprising: an arrangement of elongated members connected by a plurality of connectors to define the frame assembly, the connectors including a plurality of knuckle joint assemblies for articulably connecting the elongated members, the connectors also including a plurality of slip-T members for connecting the elongated members to define a base of the frame assembly. The slip-T members may comprise a unitary connector housing arranged at a mid-point of an adaptor ring, wherein the adaptor ring has an open bore therethrough and the connector housing has a bore therein with a closed end for securably engaging an end of the elongated members. The knuckle joint may comprise a connector housing having a bore therein with a closed end, and an adaptor ring unitary with the connector housing, the adaptor ring having a bore therein, each or the bores having a longitudinal axis which are transverse with respect to one another. The knuckle joint assemblies may preferably partially enclose a curved elongated member, to define an annular ring of support of the frame assembly. The elongated members may be tubular and hollow. At least one of the connectors may comprise a housing saddle having an adaptor ring with a saddle thereon for a snap receipt of a carried elongated member, to permit sliding adjustment of elongated members in the frame assembly. The saddle may comprise a channel shaped member for providing a 180 to about a 240 degree encirclement of the carried elongated member. The ring may comprise an elongated member heated to permit arcuate bending thereof.

The invention also may comprise a frame assembly to provide temporary housing structure for an article, comprising: a pair of parallel, elongated side members and a pair of elongated, parallel end members connected by an arrangement of slip-T connectors on the elongated side members; and an inverted U-shaped framework having ends attached to a further plurality of slip-T connectors arranged on the elongated, parallel side members. The inverted U-shaped framework may comprise a plurality of arcuately shaped tubular members connected by an insert connected therebetween. An enclosure cover is preferably attached to the outside of the frame assembly to provide an enclosed housing for the article therewithin.

The invention may also include a method of constructing a temporary tubular frame assembly for the customizable enclosure of an article, the assembly comprising: arranging a plurality of parallel, elongated tubular side members and a plurality of parallel, elongated tubular end members as a rectilinear base; connecting the side members with an end of the end members by a connector housing, the connector housing having a bore therein with a closed inner end; connecting a plurality of vertical, elongated members to the rectilinear base each at the connector housings; attaching a knuckle assembly at an upper end of each of the vertical members, and mounting a 5-way hub onto the knuckle assembly on the elongated members to define a frame structure for customizable construction of an enclosure for the article; pushing an elongated member through a bore in each of the knuckle assemblies; heating the elongated member to permit it to be bent into a curved of arcuate shape; attaching a housing saddle onto the elongated member to permit a further elongated member to be adjustably supported therefrom.

The invention may also comprise a frame assembly for temporarily housing an article, comprising: a plurality of elongated members to define a rectilinear base, connected at a corner by adjacent elongated members by a slip-T connector slidably connected therebetween; a plurality of generally vertically disposed elongated members to define vertical posts, having lower ends inserted into further slip-T connectors slidably disposed on a pair of the elongated members of the rectilinear base; a first knuckle joint assembly attached to an upper end of said vertically disposed elongated members, to permit articulation of further elongate members attached thereto; a lower end of a further elongated member attached to an upper end of the first knuckle joint assembly; and a 5-way hub connectively attached to an upper end of the further elongated member to define a roof frame to the housing structure.

The 5-way hub may be connected to an upper end of a second knuckle joint assembly, and the second knuckle joint assembly may have a lower end which is connected to an elongated member, which elongated member is connected to an upper end of the first knuckle joint assembly, thus defining a multiple slope to the roof frame.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
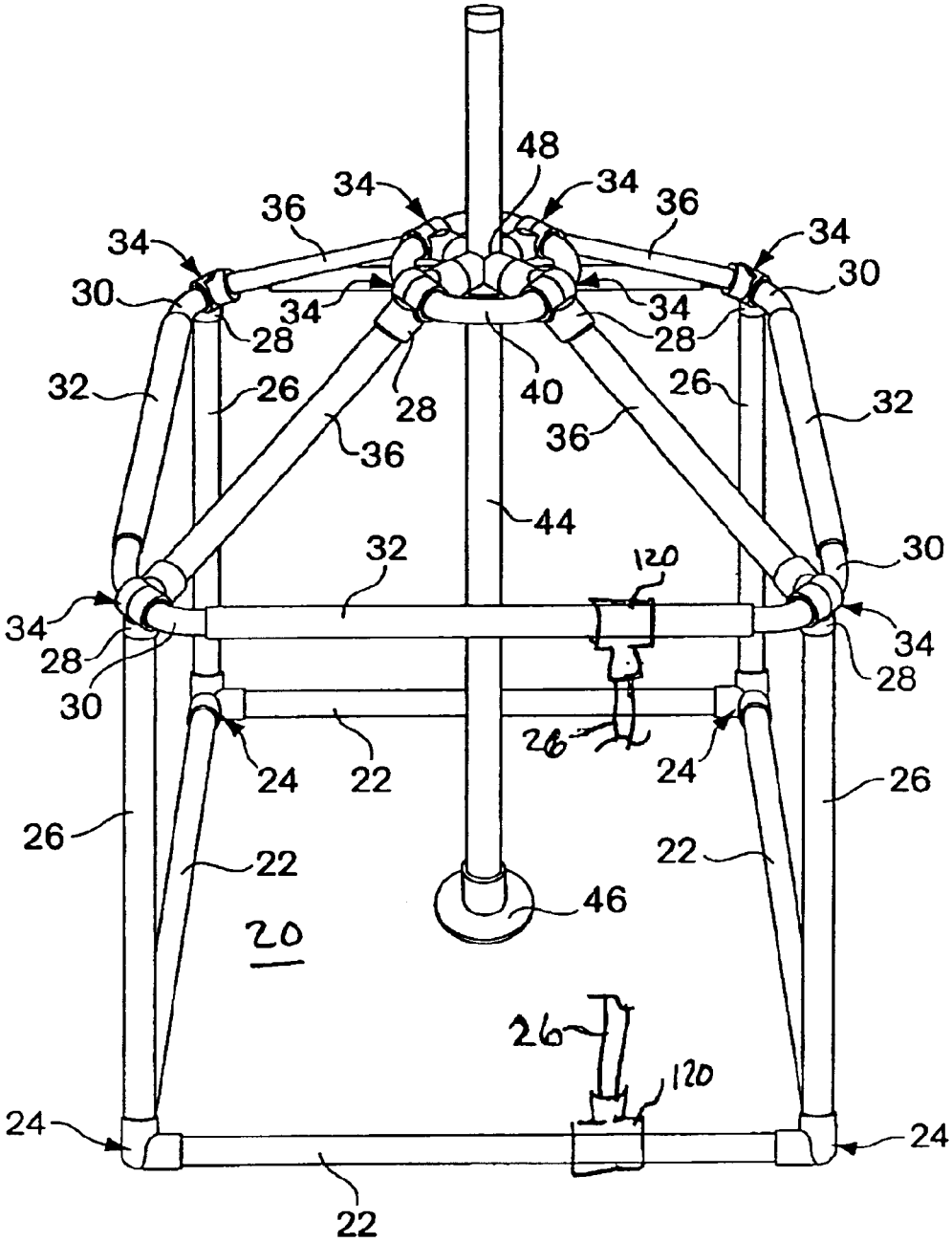
FIG. 1 is a perspective view of a frame assembly utilizing components constructed according to the principles of the present invention.

Referring now to the drawings in detail, and particularly to FIG. 1, there is shown the present invention which comprises versatile, easy to assemble, readily customizable frame assembly 20 to be utilized as a temporary or a permanent structure which may be covered by an external panel or fabric. Such a frame assembly 20, for example, may comprise a plurality of elongated horizontally disposed tubes 22 connected in a rectilinear manner by, for example, a three way corner member 24, which each corner member 24 mating with a vertical tube 26 which is connected to a knuckle joint 28 at its uppermost end, as shown in FIG. 1. The knuckle joints 28 are connected by horizontally disposed tubular members 30 which may be bent in a curved fashion at the corners, as also shown in FIG. 5, and which tubular members 30 are themselves abutively held connected together by a straight coupling member 32.

Figure 2:
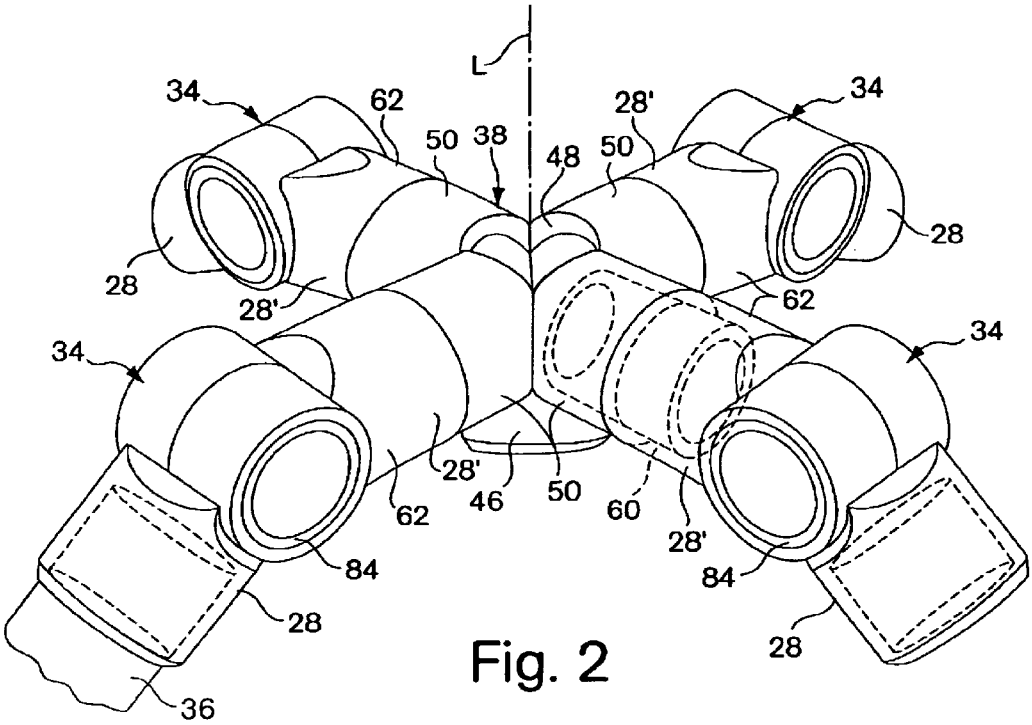
FIG. 2 is a perspective view of a 5-way hub with associated knuckle joint assemblies which were shown in FIG. 1.
Figure 5:
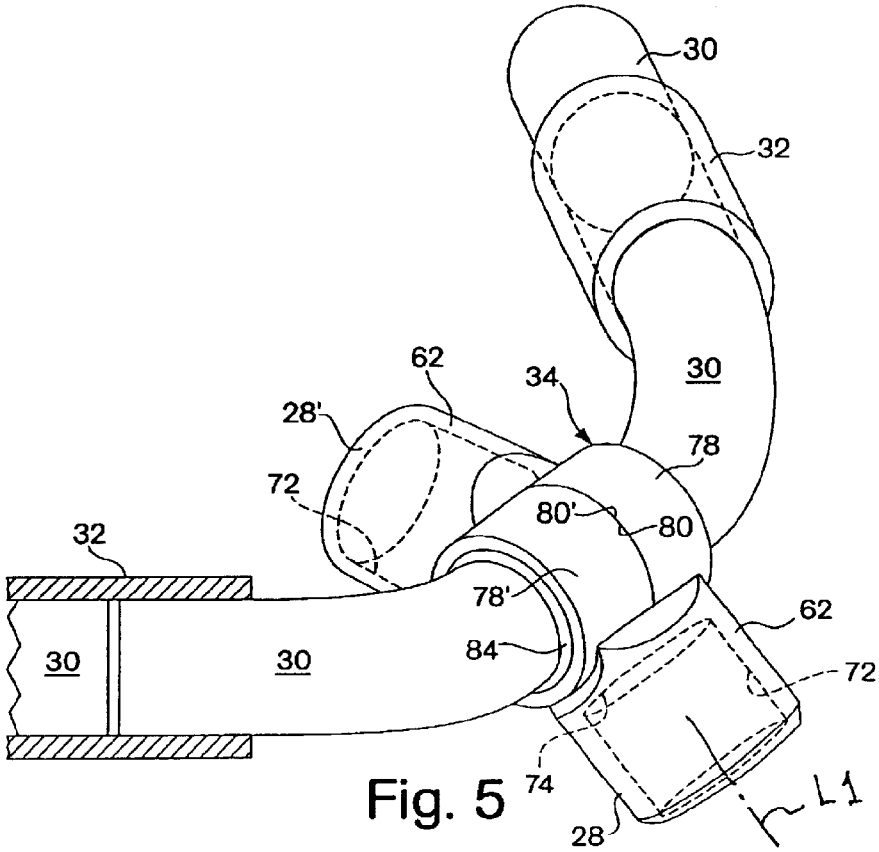
FIG. 5 is a perspective view of one of the upper corners showing a knuckle joint assembly represented in FIG. 1.
Figure 6:
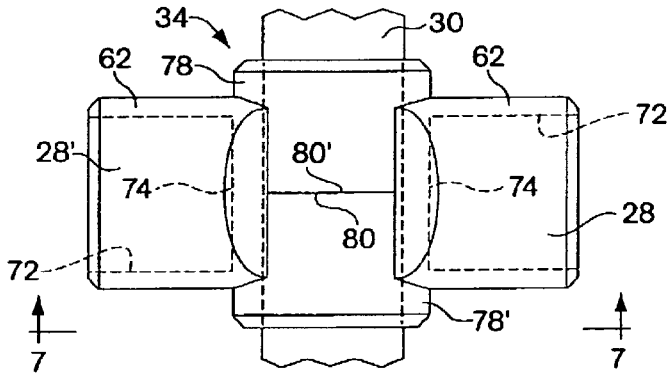
FIG. 6 is a plan view of a knuckle joint assembly shown in FIG. 5.
Figure 7:
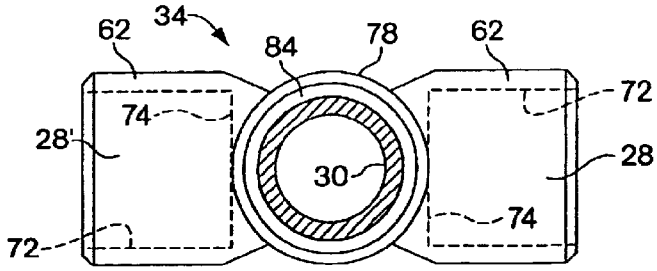
FIG. 7 is a view taken along the lines 7—7 of FIG. 6.
Figure 8:
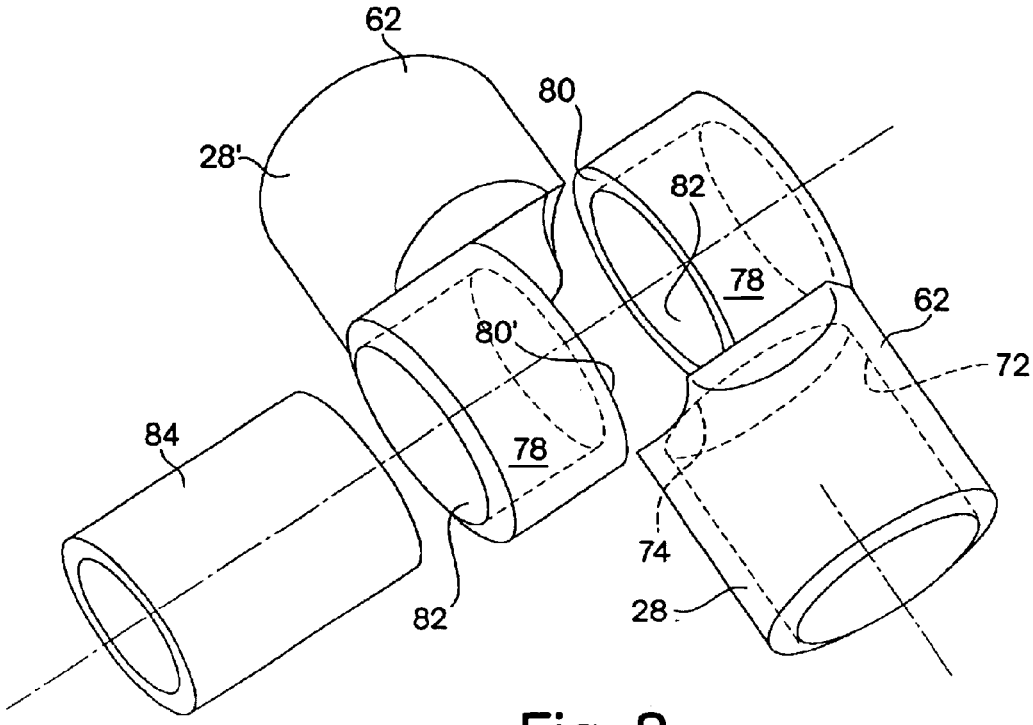
FIG. 8 is an exploded view of a knuckle joint assembly.

A pair of knuckle joints 28 and 28' articulably connected together comprise a knuckle joint assembly 34, having a first end and a second end, as shown in FIGS. 1, 2 and 5. The knuckle joint assemblies 34 may be further connected to an elongated tubular (or solid) corner brace 36, directed towards a central hub assembly 38, best shown in FIG. 2, and connected thereto by a further set of knuckle joint assemblies 34. A bent or heat formed ring 40 may be passed through each knuckle joint assembly 34 to form the hub assembly 38, each of which knuckle joint assembly 34 having one knuckle joint 28 connected to a 5-way hub member 42, as best shown in FIG. 2 to define a further slope to the roof frame thereat. A center pole 44 may be arranged to extend through the frame assembly 20 from a flanged horizontal base 46, and its upper end through a central bore 48 within the 5-way hub 42 of the hub assembly 38, for central support of the entire frame assembly 20, depending upon its size and elevation.

Figure 3:
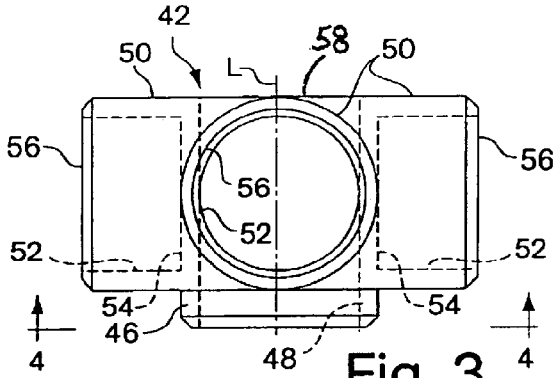
FIG. 3 is a side elevational view of the 5-way hub shown in FIG. 2.
Figure 4:
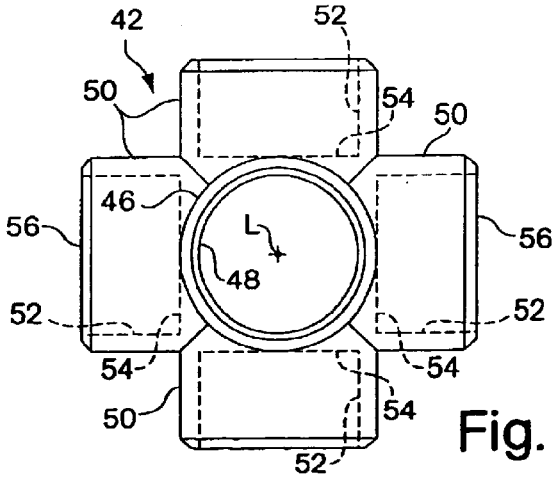
FIG. 4 is a view taken along the lines 4—4 of FIG. 3.

The 5-way hub 42, as shown in FIGS. 2, 3 and 4 comprises a molded, central X-shaped housing, having a lower boss 46. The X-shaped hub 42 comprises four connector housings 50 equally spaced therearound at a 90 degree angle with respect to the longitudinal axis "L" of the center bore 48, as shown in FIG. 4. Each connector housing 50 has a receiving bore 52 formed therein. Each receiving bore 52 has a closed innermost end 54 and an open radially-outermost end 56. The central bore 48 of the center cylinder has an open upper end 58 which extends through the boss 46 into the open lower end 56. Each connector housing 50 of the 5-way hub 42 is abutively attached to a knuckle joint 28' by an internal tubular coupling sleeve 60 in each of the respective receiving bores 52, as represented in FIG. 2. The internal connector or coupling sleeve 60 connects the receiving bore of each respective connector housing on the 5-way hub 42 with a corresponding receiving bore 52 on a connector housing 62 of an adjacent knuckle joint 28. Each connector housing 62 of the 5-way hub 42 is connected to a respective knuckle joint 28 by the internal sleeve 60 matingly arranged therebetween, in their respective receiving bores 52.

A first knuckle joint 28 and a second knuckle joint 28' are articulably arranged adjacent one another to define a support for the internal tube 30 arranged therebetween, as shown in FIG. 5. The tube 30 may be ribbed, and it may be formed in a curved manner as by heat from a heating lamp, a heating element, or a heated blanket or the like. A knuckle joint assembly 34 is thus comprised of a first knuckle joint 28 and a second knuckle joint 28'. Each knuckle joint 28 or 28' has the connector housing 62 having a receiving bore 72 extending therein. The receiving bore 72, as afore-mentioned has an inner closed end 74, and an open second or outer end 76. The receiving bore 72 has a longitudinal axis "L1" which is coaxial with the longitudinal axis of the connector housing 62. The connector housing 62 has an adaptor ring 78 unitarily formed at the closed end of the connector housing 62. The adaptor ring 78 has an annular edge surface 80 which mates against a corresponding annular surface 80 of a corresponding adaptor ring 78' of a second knuckle joint 28' of the joint assembly 34, as shown in FIGS. 5, 6, 7 and 8. The second knuckle joint 28 is unitarily formed with a connector housing 62. The second knuckle joint connector housing 62 has a receiving bore 82 in a manner similar to that of the first knuckle joint 28. A cylindrically-shaped sleeve 84 may be inserted through the respective bores 82 and 82 of the respective first and second adaptor rings 78 and 78', as represented in an exploded view in FIG. 8, to connect the two knuckle joints 28 and 28' together to comprise the knuckle joint assembly 34. The sleeve 84 may be comprised of an elongated tube or the sleeve may be comprised of a shortened tube which is adapted to permit a further smaller diameter tube to be inserted therewithin.

Figure 10:
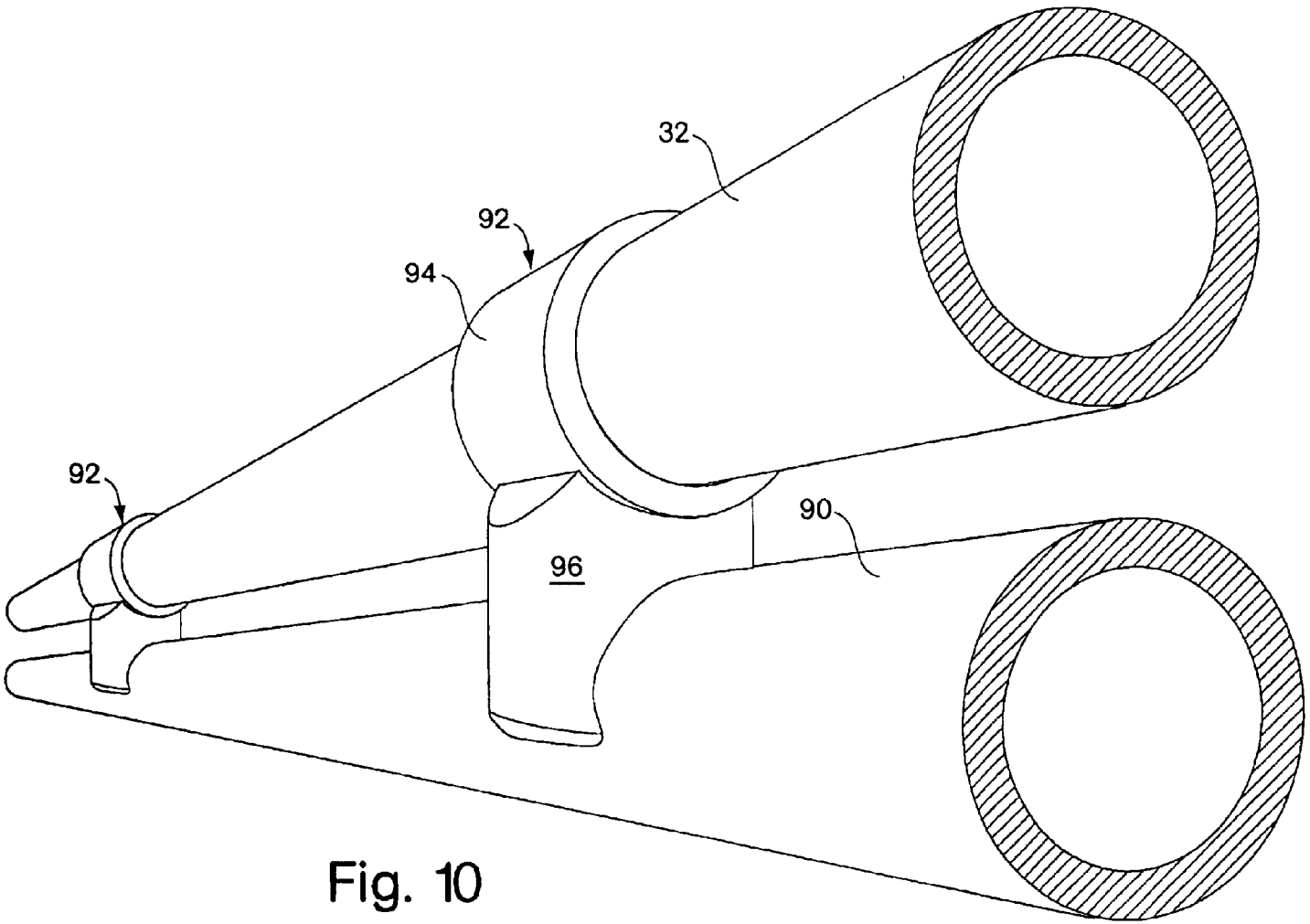
FIG. 10 is a perspective view of a carrier tube and a supported tube with a slip-T saddle connector supportedly arranged therebetween.

The elongated tube (for example #32) between adjacent knuckle joint assemblies 34 on the frame assembly 20 may have a supported tube 90 carried thereon. The supported tube 90 would be parallel to and adjacent the carrier tube 32 which is arranged between adjacent knuckle joint assemblies 34. The carrier tube 32 would have one or more "slip T" saddle connectors 92 therewith, as represented in FIG. 10.

Figure 9:
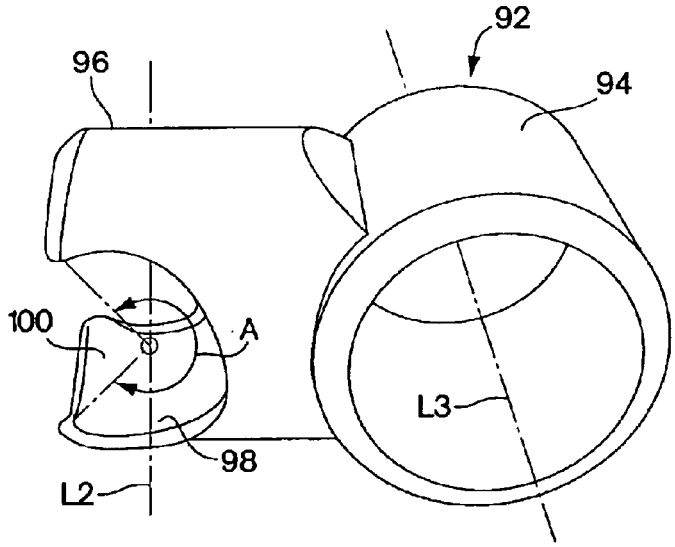
FIG. 9 is a perspective view of a slip connector saddle joint of parallel alignment.

The "slip T" saddle connector 92, as shown in FIG. 9 comprises an adaptor ring 94 unitarily formed with a connector housing saddle 96. The adaptor ring 94 comprises a cylindrically shaped member connected to the generally cylindrically shaped housing saddle 96. The housing saddle 96 comprises a saddle joint with a generally circumferentially shaped opening 98 arranged transversely with respect to the longitudinal axis "L2" of the housing saddle 96. The longitudinal axis "L2" of the housing saddle 96 is parallel to the longitudinal axis "L3" of the adaptor ring 94, in a first embodiment thereof as represented in FIG. 9. The housing saddle 96 includes a formed opening 100 of generally cylindrical configuration, which opening 100 is an arcuate shape "A" of between 180 degrees to 240 degrees.

Figure 11:
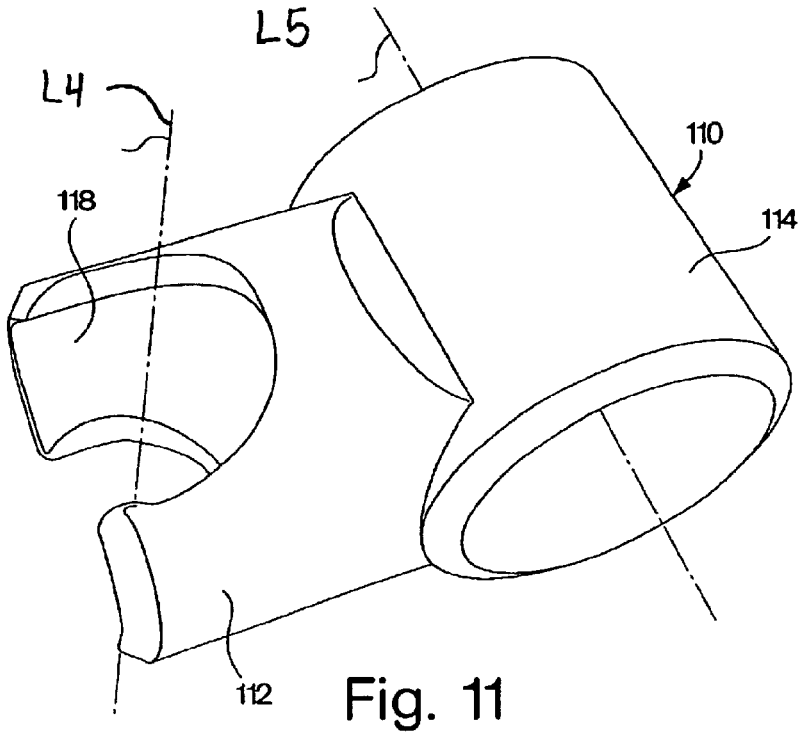
FIG. 11 is a perspective view of a slip-T saddle connector with a cross axis alignment.
Figure 12:
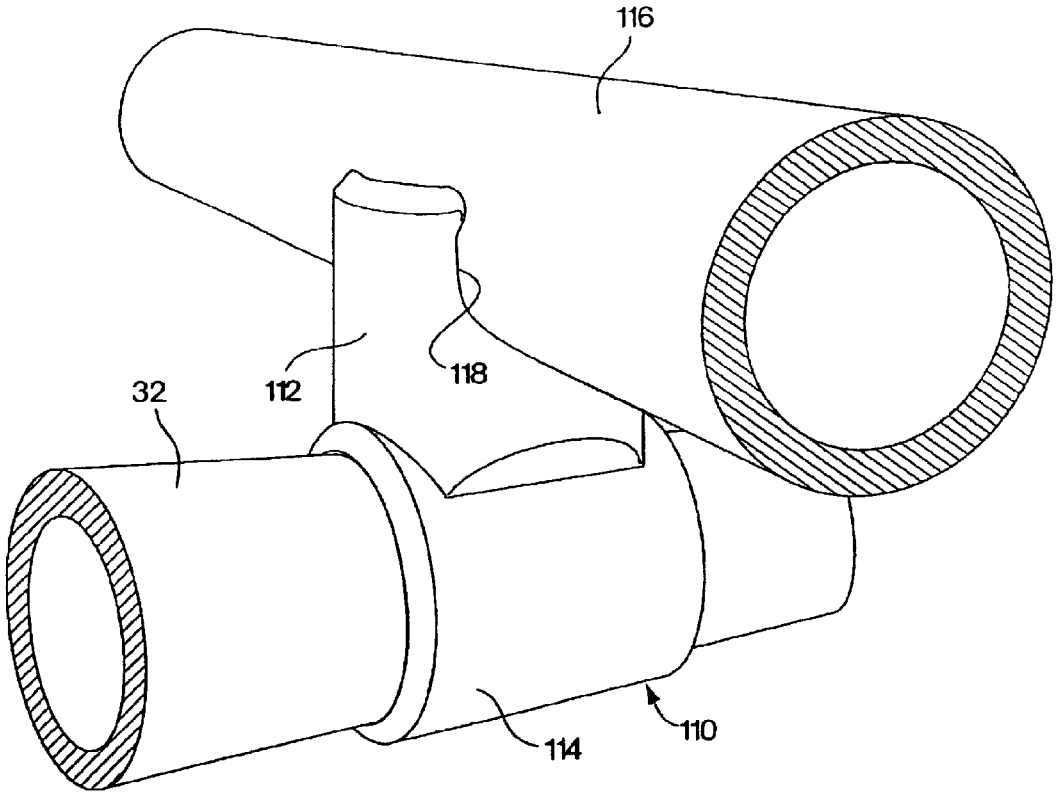
FIG. 12 is a perspective view of a carrier tube and a slip-T saddle connector in cross alignment supporting a carried tube therewith.

A slip T connector saddle joint 110 in a further embodiment, as represented in FIG. 11, may have a connector housing saddle 112 arranged unitarily with the adaptor ring 114 so that the joint of the saddle 112 has a longitudinal axis "L4" which is transverse with respect to the longitudinal axis "L5" of the bore of the adaptor ring 114. In such a slip T saddle connector 110 with a cross-aligned axis arrangement as represented in FIGS. 11 and 12, a carrier tube 32 may be arranged through the bore of the adaptor ring 114 with the connector housing saddle 112 biasedly engaging and slidably supporting a supported tube 116, the axes of each tube being transverse with respect to one another. The connector housing saddle 112 has its angularity of the opening 118 such that the supported tube 116 is snapped into the opening 118 or may be slid therethrough by virtue of the greater than 180 degree periphery of the saddle joint contact joint arrangement.

Figure 13:
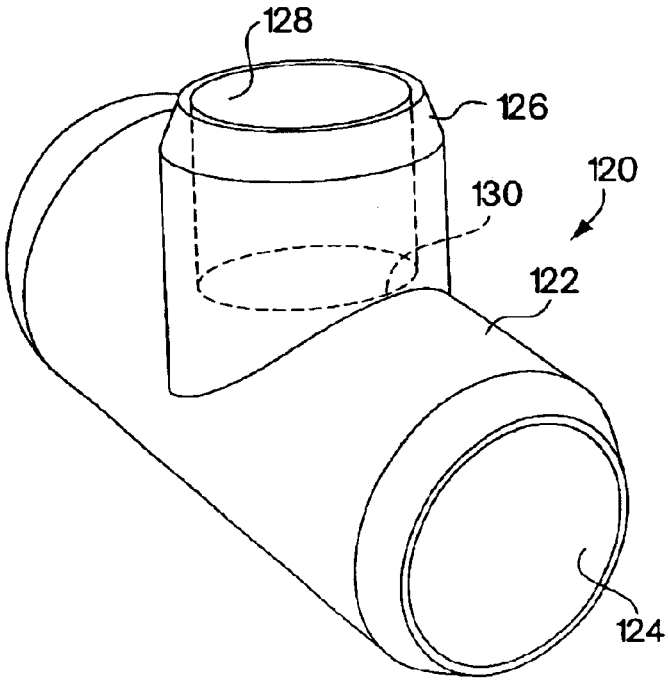
FIG. 13 is a perspective view of a straight T connector.

The frame assembly 20 as aforementioned, may include a slip or straight T member 120, having an elongated adaptor ring 122 with a bore 124 extending therethrough, and a connector housing 126 of generally cylindrically configuration, unitarily formed therewith, having a receiving bore 128 therein, with a vertical member 26 in the bore 126 of the T-slip member as represented in FIG. 1, and used to help define a base of the frame assembly 20, and as the slip-T member 120 being shown more closely in FIG. 13. The receiving bore 128 in this embodiment, preferably has a closed innermost end 130.

Figure 14:
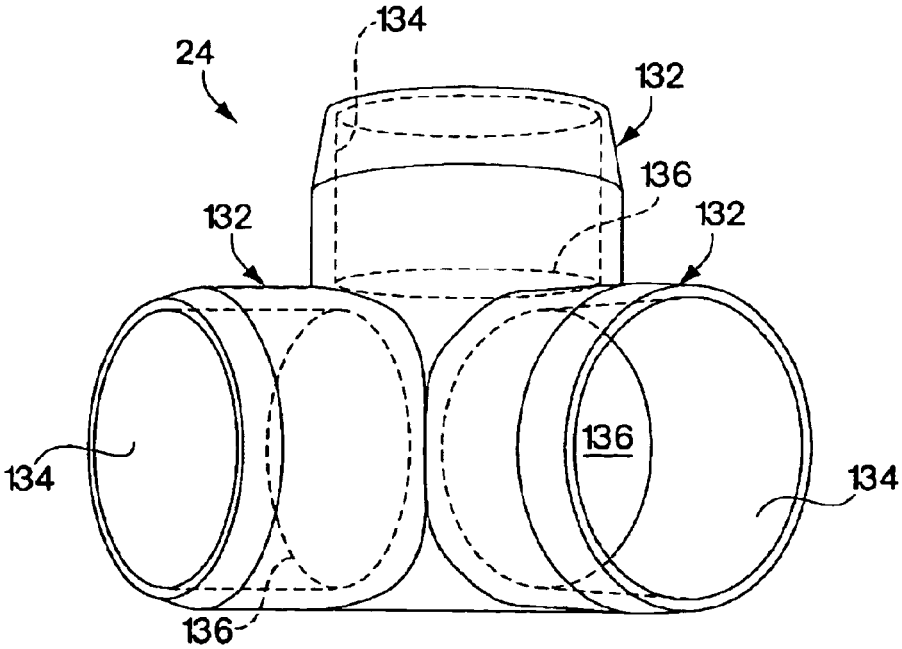
FIG. 14 is a perspective view of a three way corner member.

A further component of the frame assembly 20 described hereinabove, includes the unitary three way corner member 24 having three connector housings 132, each of generally cylindrical shape, meeting at a common boundary hub, to define a connecting joint for the receipt of elongated tubes (22 and 26) at the corner of a structure assembly 20. Each three way corner member 24 has its connector housings 132 with their respective receiving bores 134 having a closed inner end 136, as shown in FIG. 14.

Figure 15:
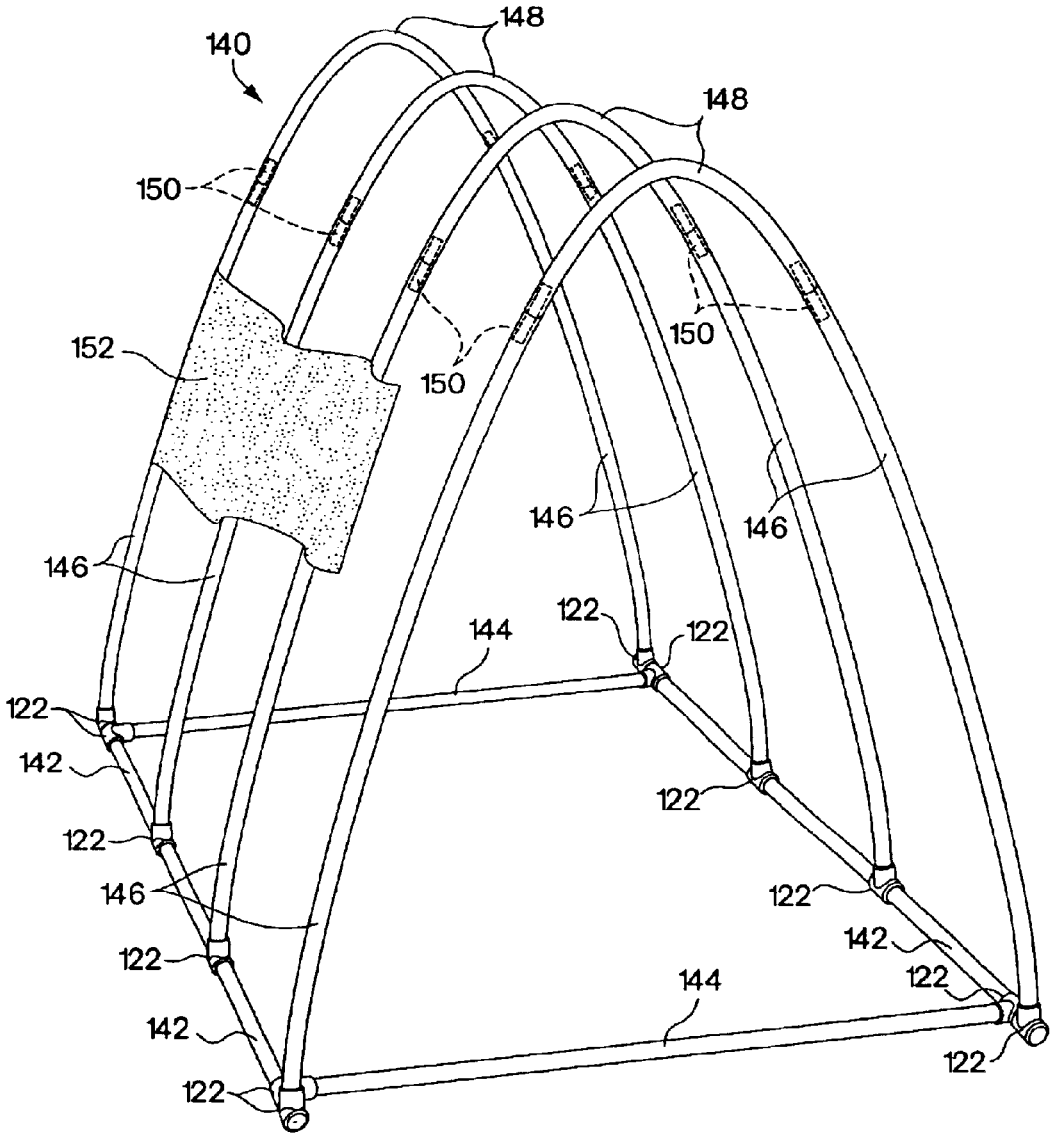
FIG. 15 is a perspective view of a frame assembly construction in a further embodiment thereof.

A further preferred embodiment of a frame assembly 140 utilizing some of the components in the aforementioned examples is shown in FIG. 15, which assembly 140 may comprise a rectilinear configuration of elongated tubular members 142 and 144 defining a base. The rectilinear formation of the base comprises a pair of parallel side members 142 and a pair of parallel end members 144, as presented. The parallel side members 142 may each have a plurality of straight T components 122 slidably disposed thereon. The connector housing 126 of each straight T member 122 may have an arcuately curved pole 146 extending therefrom. Each opposed arcuately curved pole 146 from the respective side portions of the rectilinear base may be connected by a curved tube 148, which curved tube 148 is connected to its respective arcuate curved poles by an insert connector 150 matingly arranged therebetween, to define a "roof frame" for the structure. The frame assembly 140 of this/these example/s thus may be covered by a flexible fabric, or frame panel 152 arrangement so as to permit the safe enclosure of for example a bicycle, a motorcycle, a play house, or a tool arrangement therewithin.

The elongated tubing connecting the particular comers or knuckle joint assemblies of the present invention may be comprised of one and one quarter inch diameter PVC tubing or fluted tubing. Pins may be arranged between the respective connector housings and the elongated tubings received therein, to act as anchors for securement thereof. The heating of the elongated tubing may be accomplished by the aforementioned blanket or heated element so as to raise the temperature of the tubing to about 400 degrees Fahrenheit to permit that elongated tubing to be bent into a comer or into an arcuate shape as necessary.

Thus what has been shown is a unique framing assembly for the temporary or permanent construction of an enclosure which is readily customizable by a variety of connector components.

We claim:

1. A customizable enclosable frame assembly for providing a housing structure comprising:

an arrangement of hollow, tubular, elongated members connected by a plurality of various connectors to define said frame assembly, said connectors including a plurality of articulable knuckle joint assemblies for articulably connecting said elongated members, said connectors also including a plurality of corner members for connecting said elongated members to define a base of said frame assembly, wherein said connectors also comprise slip-T members comprising a unitary connector housing arranged at a mid-point of an adaptor ring, wherein said adaptor ring has an open bore therethrough and said connector housing has a bore therein with a closed end for securably engaging an end of said elongated members; and wherein at least one of said connectors comprises a housing saddle having an adaptor ring with a saddle thereon for a snap receipt of a carried elongated member, to permit sliding adjustment of elongated members in said frame assembly.

2. The frame assembly as recited in claim 1, wherein said knuckle joint assemblies each comprise a connector housing having a bore therein with a closed end, and an adaptor ring unitary with said connector housing, said adaptor ring having a bore therein, each of said bores having a longitudinal axis which are transverse with respect to one another.

3. The frame assembly as recited in claim 1, wherein said knuckle joint assemblies partially enclose a curved elongated member, to define an annular ring of support of said frame assembly.

4. The frame assembly as recited in claim 1, wherein said saddle comprises a channel shaped ember for providing about a 180 to about a 240 degree encirclement of said carried elongated member.

5. The frame assembly as recited in claim 3, wherein said annular ring comprises an elongated member heated to permit arcuate bending thereof.

6. A method of constructing a temporary tubular frame assembly for the customizable enclosure of an article, said assembly comprising:

arranging a plurality of parallel, elongated tubular side members and a plurality of parallel, elongated tubular end members as a rectilinear base;

connecting said side members with an end of said end members by a connector housing, said connector housing having a first bore therethrough and a second bore therein with a closed inner end;

connecting a plurality of vertical, elongated members to said second bore in said connector housing on said rectilinear base;

attaching a first end of a knuckle assembly at an upper end of each of said vertical members, and mounting a 5-way hub onto a second end of said knuckle assembly on said elongated members to define a roofed frame structure for customizable construction of an enclosure for said article.

7. The method as recited in claim 6, including:

pushing an elongated member adaptor ring through a bore in each of said knuckle assemblies.

8. The method as recited in claim 7, including:

heating said elongated member adaptor ring to permit it to be bent into a curve of arcuate shape.

9. A frame assembly for temporarily housing an article, comprising:

a plurality of elongated members to define a rectilinear base, each of said elongated members connected at a corner of adjacent elongated members by a corner connector slidably connected therebetween;

a plurality of generally vertically disposed elongated members to define vertical posts, each of said elongated members having a lower end inserted into one of said corner connectors slidably disposed on pair of said elongated members of said rectilinear base;

a first knuckle joint assemble attached to an upper end of said vertically disposed elongated members, to permit articulation of further elongate members attached thereto;

a lower end of a further elongated member attached to an upper end of said first knuckle joint assembly; and a 5-way hub connectively attached to an upper end of said further elongated member to define a roof frame to said housing structure.

10. The frame assembly as cited in claim 9, wherein said 5-way hub is connected to an upper end of a second knuckle joint assembly, and said second knuckle joint assembly has a lower end which is connected to an elongated member, which elongated member is connected to an upper end of said first knuckle joint assembly, thus defining a multiple slope to said roof frame.

* * * * *